US006214067B1

(12) United States Patent
Hanson

(10) Patent No.: US 6,214,067 B1
(45) Date of Patent: Apr. 10, 2001

(54) MAGNESIUM OXYCHLORIDE PLUG-FILLED MAGNESIUM OXYCHLORIDE BONDED ABRASIVE

(76) Inventor: David B. Hanson, 4923 Pitt Rd., Afton, WI (US) 53501

( * ) Notice: Subject to any disclaimer, the term of this patent is extended or adjusted under 35 U.S.C. 154(b) by 0 days.

(21) Appl. No.: 09/401,831

(22) Filed: Sep. 22, 1999

(51) Int. Cl.[7] ..... B24D 3/00; B24D 3/02; B24D 3/12; B24D 17/00

(52) U.S. Cl. ..... 51/295; 51/298; 51/306; 51/307; 51/309; 51/293; 51/308; 106/688; 451/548

(58) Field of Search ..... 51/295, 298, 306, 51/307, 309, 293, 308; 451/548; 106/688

(56) References Cited

U.S. PATENT DOCUMENTS

| | | | | |
|---|---|---|---|---|
| 3,864,140 | | 2/1975 | Ferrigno . | |
| 5,460,635 | * | 10/1995 | Koch et al. | 51/307 |
| 5,624,472 | * | 4/1997 | Koch et al. | 51/307 |
| 5,679,119 | * | 10/1997 | Freeman et al. | 51/309 |

* cited by examiner

*Primary Examiner*—Michael Marcheschi

(57) ABSTRACT

Corrugated abrasive discs such as grinding wheels are treated by applying a water-resistant coating to the interiors of the corrugations before the corrugations are plugged. Discs having water-sensitive matrices such as magnesium oxychloride cement are thus protected against water or water vapor seepage from aqueous-based plug fill material.

24 Claims, 1 Drawing Sheet

MAGNESIUM OXYCHLORIDE PLUG-FILLED MAGNESIUM OXYCHLORIDE BONDED ABRASIVE

BACKGROUND OF THE INVENTION

Abrasive bonds are used in the manufacture of abrasive discs or grinding wheels intended for various grinding applications. The discs are made to specifications which suit them for specific applications, such as dry or wet grinding, light or heavy stock removal, and a range of workpiece materials. Disc specifications typically include a description of abrasive grain types and sizes used, disc grades (strength of bond), disc structure (density of abrasive grain) , disc bond type (resinoids, cementitious, ceramic, other) , and disc configuration. This last refers to characteristics of the face (surface) of the disc, which is varied according to application needs, such as cutting action, temperature control requirements, size and type of workpiece, and desired finish.

For applications requiring a fast, cool cutting action, disc faces are often configured with a plurality of holes punched through the thickness of the disc perpendicular to the plane of the face, which serve to improve coolant distribution during use; these wheels are referred to in the art as "corrugated" wheels, and the holes are referred to as "corrugations." Combination configurations for special applications include corrugations with radial grooves and combinations of corrugated and smooth surfaces on the same disc face. Corrugations in small, medium, large and extra large sizes are in use. Corrugated discs and grinding wheels of the type useful in the practice of the present invention are illustrated and discussed in "High Performance Abrasive Products" (1997), a publication of Landis-Gardner Co., 20 E. Sixth Street, Waynesboro, Pa., USA, incorporated herein by reference.

It has previously been proposed to modify the properties of corrugated discs by plugging the corrugations. This concept has several advantages in theory: the plugs provide an interrupted cutting action which is useful for larger surface area parts or heat sensitive parts where constant contact with the wheel face can generate too much heat and cause warping or burning of the part; the wheel costs less to produce than a solid wheel, as more expensive abrasive materials such as diamond, CBN, or sol gel grain abrasives can be limited to the plug elements with little, if any, change in grinding result; and spalling caused by heat concentration at the center of wheels such as nut-inserted discs may be reduced.

In practice, however, it has not been possible to effectively plug corrugations in water-sensitive bonds with desirable aqueous-based plug materials. Owing to the size of the corrugations ("small" corrugations are typically about ¼"–⅜" in diameter and 3" deep), the plug material must initially have very low viscosity to permit the corrugations to be readily filled without significant air entrapment. This means that typical aqueous-based settable compositions for use as corrugation fill material must initially contain an excess of water for lowering the viscosity of these compositions to a useful range for filling.

Unfortunately, this approach is not feasible for plugging corrugated cementitious abrasive bonds such as magnesium oxychloride bonds ("oxychloride bonds"). It is well known that these bonds are highly sensitive to water. The excess water in these aqueous fill compositions inevitably seeps or is drawn into the wheel matrix while the compositions set up, irrespective of the specific material employed. This phenomenon results in a volume change in the bond matrix which degrades the bond, frequently causing radial cracks or other imperfections which render the wheel unusable. Accordingly, a different method for plugging corrugations in cement-bonded abrasive grinding wheels with aqueous-based material has been needed.

SUMMARY OF THE DISCLOSURE

Figure 1:
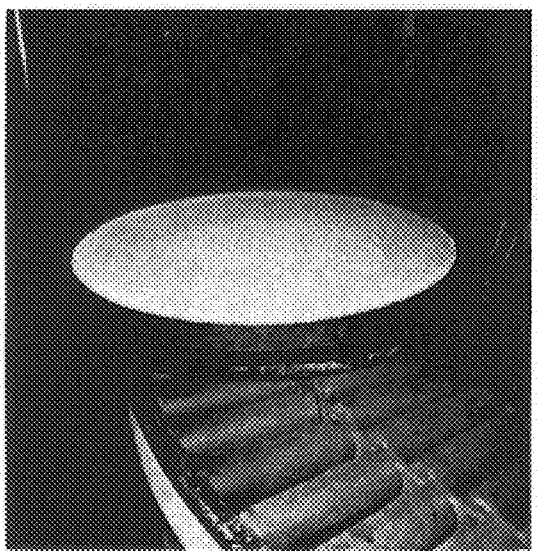
FIG. 1 is a photograph of a magnesium oxychloride bonded abrasive after molding (note smooth face)

The invention provides a method for plugging corrugations in water-sensitive cementitious abrasive bonds comprising precoating the inner surfaces of the corrugations with a water-resistant film prior to plugging with an aqueous-based fill material. The invention further provides grinding wheels (abrasive discs) comprising corrugated cementitious abrasive bonds wherein the corrugations are coated with a water-resistant film prior to filling.

DETAILED DESCRIPTION OF THE DISCLOSURE

According to one embodiment of the invention, the corrugations of a pre-cured magnesium oxychloride bonded abrasive wheel are coated on the inner surfaces thereof with a composition comprising a water-resistant film-forming material. The film is then dried or otherwise cured to form a water-resistant film or coating on the interior walls of the corrugations. The corrugations are thereafter filled with a selected low-viscosity aqueous-based fill material. The fill material is then cured to form a solid plug within the corrugations. The plugged wheel is then post-cured as appropriate for the abrasive bond material as known in the art.

The above process is applicable to abrasive bonds of cementitious materials other than magnesium oxychloride bonds, although these bonds are the most commonly used cementitious bonds for grinding wheels. As previously noted, exemplary corrugated grinding wheels and abrasive discs which can be improved according to the invention are described in "High Performance Abrasive Products," op.cit. As used herein, the term "abrasive discs" is inclusive of grinding wheels.

Suitable materials for coating the interiors of the corrugations according to the invention comprise known non-aqueous film-forming compositions containing a material capable of forming a water-resistant film dissolved (or dispersed) in a non-polar solvent. The film-forming material is deposited on the inner surfaces of the corrugations to form a substantially continuous water-resistant coating which is an effective barrier to water or water vapor. Preferably, the film is waterproof, i.e., the film constitutes complete barrier to seepage of water or water vapor from the uncured corrugation fill material into the interstices of the bond matrix.

Exemplary film-forming materials useful in the practice of the invention include natural and synthetic waxes, such as microcrystalline waxes of hydrocarbon or fatty acid esters or alcohols, natural or synthetic polymers or prepolymers which form water-resistant films such as silicones, fluorotelomers and polyurethanes; and natural and synthetic oils. Film formers which can form water-resistant coatings on cementitious surfaces are broadly known in the art and are generally useful in the practice of the invention.

The film-forming material is conveniently applied as a composition comprising the selected film-forming material and a sufficient amount of a non-aqueous organic solvent or diluent (usually having solvent power) to provide a coating composition having a viscosity low enough to permit easy coating of the wheel corrugations. Coating films which are formed by evaporation of solvent are generally easiest to work with and are recommended to the practitioner. Organic solvents known in the art as solvents or diluents for organic film-formers are broadly useful, particularly aliphatic and aromatic hydrocarbons, either unsubstituted or substituted with, for example, alcohol, ester, ether, ketone, amine, nitro, or chloro groups. The compositions may also include additives as known in the art which promote film formation (e.g., drying oils) or otherwise enhance the product or process for its formation. Low toxicity hydrocarbon solvents such as naphtha are recommended.

Figure 2:
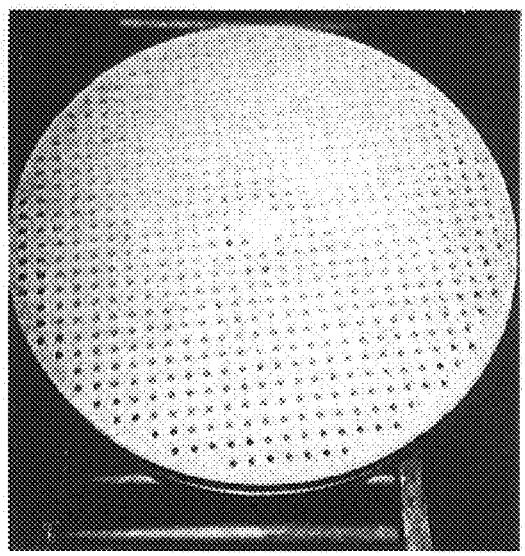
FIG. 2 is a photograph of the abrasive wheel of FIG. 1 after pressing (note corrugations)

A plugged grinding wheel according to the invention can be made by starting with a corrugated magnesium oxychloride wheel prepared as follows with reference to the Drawing:

The wheel matrix is prepared as generally known in the art. In the illustrated embodiment, a "wet ball in hand" composition (one which holds its shape when squeezed by hand) of magnesium oxide, magnesium chloride, abrasive grain(s) of choice, grain spacer(s), and/or grain replacement (s) and/or filler(s) is mixed until homogenous. The mixture is then packed into a mold and finished by striking off excess material and/or trawling to provide a flat surface (FIG. 1). Corrugations are introduced into the wheel, leaving the wheel matrix with corrugations ("holes" or "tunnels") which typically penetrate the thickness of the wheel matrix perpendicularly to its face (FIG. 2). The matrix is then allowed to pre-cure sufficiently to permit filling of the corrugations and truing of the wheel.

After this initial cure, and prior to filling the corrugations, the interior surfaces of the corrugations are coated with a liquid composition capable of forming a waterproof film comprising, for example, a microcrystalline wax dissolved in an organic solvent such as naphtha. A thin coat of the water-proofing composition is applied to the corrugations in any practicable manner such as by spraying or brushing. Any incidental application of the film composition to the face of the wheel while coating the corrugations is of no matter to the subsequent use of the wheel.

After application, the coating is left to dry and thereby form a substantially continuous water-resistant film on the corrugation surfaces which inhibits or prevents aqueous fill material from seeping into the natural pores in the wheel matrix.

Once dried, the corrugations are completely filled with an aqueous-based plug-forming fill material having a castable/pourable consistency, preferably a material similar to the matrix material for optimum strength. A particularly useful fill material for the magnesium oxychloride wheel illustrated comprises the magnesium oxychloride matrix composition with a higher liquid ($MgCl_2$, solution) content for pourability, as this material will both physically lock and chemically bond with the oxychloride matrix material on curing.

Figure 3:
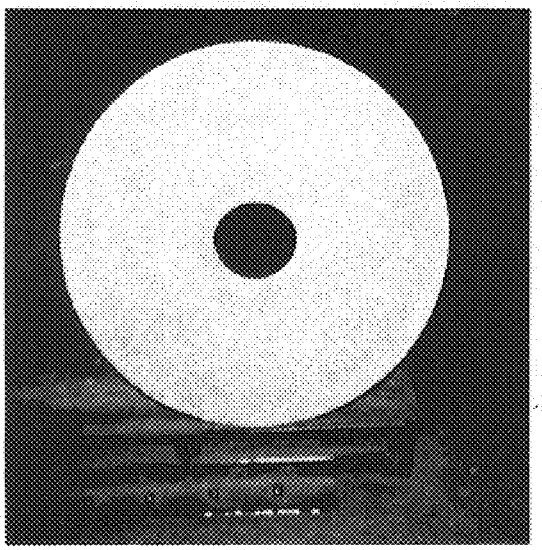
FIG. 3 is a photograph of the corrugated wheel of FIG. 2 after the corrugations have been plugged according to the invention.
Figure 4:
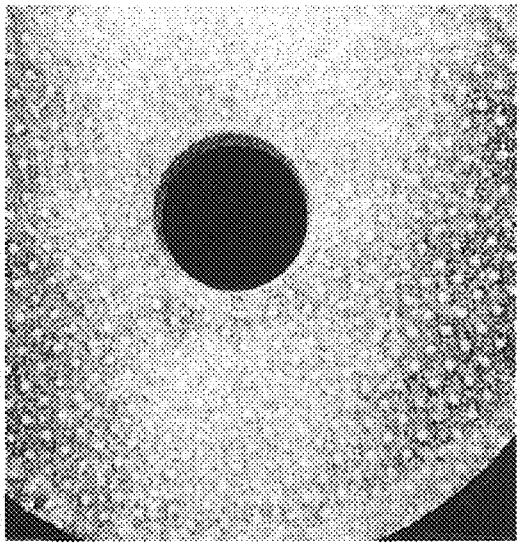
FIG. 4 is a close-up photograph of the wheel of FIG. 3, showing the plugs (filled corrugations).

The corrugation fill material is allowed to cure to form plugs, and the entire wheel is then trued. The product (FIGS. 3 and 4) is then post-cured as known in the art.

Waterproofing according to the invention allows the wheel matrix to be plugged with an aqueous-based fill material without damaging the wheel in the process. Also, better heat dissipation is achieved. The process permits the formation of plugs which are harder and stronger than the wheel matrix owing to their higher density, fewer voids and high bonding characteristics, and this allows the plugs to protrude just slightly above the surrounding matrix (i.e., the wheel matrix wears away faster). Thus, the plugs do most of the grinding (cutting) and provide an "interrupted" cutting action which allows the workpiece to cool slightly in between grinding passes. In contrast, a smooth face wheel (not corrugated) is in constant contact with the workpiece, which tends to generate much more friction and heat. Also, the fact that the plugs are higher in density than the matrix and have very little porosity enables them to absorb and dissipate the heat of grinding more efficiently - i.e., they provide a better heat sink.

EXAMPLES

A. Materials

The following materials were used to fill and plug a magnesium oxychloride abrasive wheel bond as described above:

1. Film-forming Composition Formula:

| | Wt. % |
|---|---|
| Oxidized Microcrystalline Carnauba Wax[1] | 1–10% |
| VM & P Naphtha[2] | 90–99% |

[1]Stoner, Inc., Quarryville, PA, USA-Product ID# 6844-09-8 (CAS)
[2]Stoner. Inc., Quarryville, PA, USA-Product ID# 8032-32-4 (CAS)

2. Plug Fill Material Formula:

| | Wt. % |
|---|---|
| Grain/Grain Replacements | 48–58% |
| Magnesium Oxide | 19–24% |
| 25–30% Magnesium Chloride Brine | 23–29% |

3. Exemplary Wheel (Matrix) Formula:

| | Wt. % |
|---|---|
| Grain/Grain Replacements | 70–80% |
| Magnesium Oxide/Fillers | 10–20% |
| Magnesium Chloride Brine | 10–15% |

B. Methods

After water-proofing and plugging the wheel matrix corrugations with these film-forming and plug-fill compositions as described above, the filled corrugations were allowed to cure for about 16 hours. After truing, the wheel matrix was allowed to post-cure from 20–50 days for maximum strength, in customary fashion.

No volume change (swelling) was observed in the finished wheel product due to water seepage from the plug fill material. The wheel was judged a good commercial product.

What is claimed is:

1. A corrugated water-sensitive cementitious abrasive bond wherein the corrugations are coated on the inner surfaces thereof with a water-resistant coating.

2. The abrasive bond of claim 1, wherein the coating comprises a substantially continuous water-resistant coating formed from a liquid non-aqueous film-forming composition deposited on the inner surfaces of the corrugations.

3. The bond of claim 2, wherein the water-resistant coating comprises a natural or synthetic wax, oil, polymer, or prepolymer.

4. The bond of claim 3, wherein the water-resistant coating comprises a wax.

5. The bond of claim 4, wherein the water-resistant coating comprises a microcrystalline wax.

6. The bond of claim 3, wherein the water-resistant coating comprises a natural or synthetic polymer or prepolymer.

7. The bond of claim 6, wherein the water-resistant coating comprises a silicone, polyurethane, or fluorotelomer.

8. An abrasive disc comprising the abrasive bond of any one of claims 1–7 .

9. The abrasive bond of any one of claims 1–7, wherein the coated corrugations are plugged.

10. A corrugated magnesium oxychloride abrasive disc comprising any one of the abrasive bonds of claims 1–7.

11. A magnesium oxychloride abrasive disc comprising the abrasive bond of claim 1, wherein the coated corrugations are plugged.

12. A magnesium oxychloride abrasive disc comprising the abrasive bond of any one of claims 1–7, wherein the coated corrugations are plugged with a magnesium oxychloride cement optionally containing abrasive grain.

13. A method for preparing a corrugated cementitious abrasive disc having filled corrugations comprising coating the inner surfaces of the corrugations of a corrugated abrasive disc with a water-resistant material, filling the coated corrugations with a curable plug-forming fill material and curing the fill material to form a plug.

14. The method of claim 13, wherein the coating comprises a substantially continuous water-resistant coating formed from a liquid non-aqueous film-forming composition deposited on the inner surfaces of the corrugations.

15. The method of claim 14, wherein the water-resistant coating comprises a natural or synthetic wax, oil, polymer, or prepolymer.

16. The method of claim 15, wherein the water-resistant coating comprises a wax.

17. The method of claim 16 wherein the water-resistant coating comprises a microcrystalline wax.

18. The method of claim 15, wherein the water-resistant coating comprises a natural or synthetic polymer or prepolymer.

19. The method of claim 15, wherein the water-resistant coating comprises a silicone, polyurethane, or fluorotelomer.

20. The method of claim 13, wherein the coated corrugations are filled with an aqueous-based plug-forming fill material.

21. The method of claim 13, wherein the abrasive disc is a corrugated magnesium oxychloride grinding wheel and the coated corrugations are filled with an aqueous-based plug-forming fill material.

22. The method of claim 21, wherein the fill material comprises a magnesium oxychloride cement.

23. The method of claim 22, wherein the fill material contains abrasive grain.

24. The method of any one of claims 13–19, wherein the abrasive disc is a magnesium oxychloride grinding wheel.

* * * * *